US011357703B2

(12) United States Patent
Zoczek et al.

(10) Patent No.: US 11,357,703 B2
(45) Date of Patent: Jun. 14, 2022

(54) SECURE DEVICE FOR COUNTING AND DISPENSING OBJECTS

(71) Applicant: STIPLASTICS, Saint Marcellin (FR)

(72) Inventors: Guillaume Zoczek, Tullins (FR); Ludovic Soual, Romans sur Isere (FR); Hugues Brouard, Rochefort Samson (FR)

(73) Assignee: STIPLASTICS, Saint Marcellin (FR)

( * ) Notice: Subject to any disclaimer, the term of this patent is extended or adjusted under 35 U.S.C. 154(b) by 0 days.

(21) Appl. No.: 17/295,367

(22) PCT Filed: Nov. 19, 2019

(86) PCT No.: PCT/FR2019/052745
§ 371 (c)(1),
(2) Date: May 19, 2021

(87) PCT Pub. No.: WO2020/104748
PCT Pub. Date: May 28, 2020

(65) Prior Publication Data

US 2021/0386627 A1 Dec. 16, 2021

(30) Foreign Application Priority Data

Nov. 20, 2018 (FR) ..... 1871627

(51) Int. Cl.
*A61J 7/02* (2006.01)
*A61J 7/00* (2006.01)

(52) U.S. Cl.
CPC ..... *A61J 7/0076* (2013.01); *A61J 7/02* (2013.01); *A61J 2200/70* (2013.01); *A61J 2200/72* (2013.01)

(58) Field of Classification Search
CPC ..... A61J 7/02
See application file for complete search history.

(56) References Cited

U.S. PATENT DOCUMENTS 7,139,639 B2 * 11/2006 Broussard ..... G07F 17/0092 221/9
8,123,037 B2 * 2/2012 Lee ..... B65D 83/04 206/536

(Continued)

FOREIGN PATENT DOCUMENTS

| | | | |
|---|---|---|---|
| EP | 0051994 | A1 | 5/1982 |
| WO | WO-2005/044702 | A1 | 5/2005 |
| WO | WO-2015/121353 | A1 | 8/2015 |

OTHER PUBLICATIONS

International Search Report and Written Opinion for corresponding International Application No. PCT/FR2019/052745, dated Feb. 7, 2020.

(Continued)

*Primary Examiner* — Gene O Crawford
*Assistant Examiner* — Ayodeji T Ojofeitimi
(74) *Attorney, Agent, or Firm* — Marshall, Gerstein & Borun LLP

(57) ABSTRACT

A device for counting and dispensing objects, including two elements.

A first element includes a conduit for dispensing the objects to be counted and dispensed, and a second element cooperates with the first element to form two obturators which define, in the dispensing conduit a chamber suitable for containing a predetermined number of said objects.

The device includes a lock moveable between a lock state wherein said lock partially obturators the dispensing conduit, and an unlock state wherein the lock is retracted outside the dispensing conduit, the lock being configured so that the position of an object present in the chamber is not affected by a change in the state of the lock.

18 Claims, 13 Drawing Sheets

(56) References Cited

U.S. PATENT DOCUMENTS

| | | | | |
|---|---|---|---|---|
| 8,185,236 | B2 * | 5/2012 | Kim | B65B 37/04 700/242 |
| 11,147,741 | B2 * | 10/2021 | Brouard | A61J 7/02 |
| 2011/0208352 | A1 * | 8/2011 | Knoth | B65B 5/103 700/243 |
| 2011/0290818 | A1 * | 12/2011 | Leifeld | A61J 7/0076 221/151 |
| 2011/0295416 | A1 * | 12/2011 | Aquilonius | A61J 7/0481 221/98 |
| 2014/0339250 | A1 | 11/2014 | Dalpian | |

OTHER PUBLICATIONS

Preliminary search report issued for French patent application FR1871627, dated Jul. 16, 2019.

* cited by examiner

SECURE DEVICE FOR COUNTING AND DISPENSING OBJECTS

CROSS-REFERENCE TO RELATED APPLICATIONS

This application is a U.S. National stage of International Patent Application No. PCT/FR2019/052745 filed Nov. 19, 2019, which claims the benefit of priority of French Patent Application No. 1871627 filed Nov. 20, 2018, the respective disclosures of which are each incorporated herein by reference in their entireties.

FIELD OF THE INVENTION

The present invention relates to a secure device for counting and dispensing objects.

BACKGROUND

The applicant has designed a device for counting and dispensing objects, in particular homeopathic granules, soft capsules, tablets, hard capsules or micro-granules, described in document WO 2015/121353.

This device, which is intended to be coupled to a container containing the objects to be dispensed, comprises two elements which are slidably moveable relative to each other:

- a first element comprising a conduit for dispensing the objects to be counted and dispensed,
- the second element cooperating with the first to form two obturators which define, in the dispensing conduit, a chamber suitable for containing a predetermined number of said objects.

The obturators are each configured to adopt, according to the relative position of the first and of the second element:

- a so-called open configuration of the chamber, wherein each obturator defines an orifice of a dimension suitable for the passage of an object to be counted and dispensed, and
- a so-called closed configuration of the chamber, wherein said orifice has a dimension that is insufficient for the passage of an object.

Each obturator has two non-adjoining facing bevelled portions in the closed configuration, in such a way that the orifice is never entirely closed. This makes it possible on the one hand to prevent trapping an object in the obturator, which would be able to damage the object, and on the other hand to prevent shearing an object in contact with the obturator during the closure of the latter.

To release one or more objects, a user actuates the device by exerting a relative sliding force of the first and of the second element, which produces the following operating sequence:

(i) a first obturator is in the open configuration while the second obturator is in the closed configuration of the chamber, (ii) the first and the second obturators are both in the closed configuration of the chamber, (iii) the first obturator is in the closed configuration while the second obturator is in the open configuration of the chamber, (iv) the first and the second obturators are both in the closed configuration of the chamber.

In certain applications, a certain degree of securing this device would be desirable, so as to allow the release of objects only in determined conditions.

For example, personalised medicine involves the taking, by a patient, of a determined dose and which can change of a drug at a determined moment, a dose having the form of one or several of the aforementioned objects.

To prevent the patient from ingesting an unsuitable dose of the drug, or from ingesting the drug at an unscheduled moment, the device would have to be able to be controlled in order to prevent the release of objects outside a determined time range, and that to deliver only the prescribed or authorised dose during this range.

Moreover, it may be necessary to control the observance of the treatment, i.e. check that the patient has indeed taken the scheduled dose.

Another constraint linked to security is to prevent a foreign body from being able to be introduced into the container through the dispensing device, in order to prevent the contamination of the objects or the presence of foreign substances among the objects.

DISCLOSURE OF THE INVENTION

A purpose of the invention is therefore to design a device for counting and dispensing objects that is secure.

To this effect, the invention proposes a device for counting and dispensing objects, comprising two elements which are slidably moveable relative to each other,

- a first element comprising a conduit for dispensing the objects to be counted and dispensed, said conduit extending in the sliding direction,
- the second element cooperating with the first element to form two obturators which define, in the dispensing conduit, a chamber suitable for containing a predetermined number of said objects, said obturators being able to adopt, according to the relative position of said first and second elements:

- a so-called open configuration of the chamber, wherein each obturator defines an orifice of a dimension suitable for the passage of an object to be counted and dispensed, and
- a so-called closed configuration of the chamber, wherein said orifice has a dimension that is insufficient for the passage of an object, each obturator having two non-adjoining facing bevelled portions in said closed configuration, the first and second elements being arranged to procure, by relative sliding, an operating sequence of the obturators wherein:

(i) a first obturator is in the open configuration while the second obturator is in the closed configuration of the chamber, (ii) the first and the second obturators are both in the closed configuration of the chamber, (iii) the first obturator is in the closed configuration while the second obturator is in the open configuration of the chamber, (iv) the first and the second obturators are both in the closed configuration of the chamber, said device being characterised in that it is adapted for being inserted into a housing comprising a control unit and at least one actuator controlled by said control unit, and in that it comprises a lock that can be moved by the actuator between a lock state wherein said lock partially closes the dispensing conduit, and an unlock state wherein the lock is retracted outside the dispensing conduit, said lock being configured so that the position of an object present in the chamber is not affected by a change in the state of the lock.

Particularly advantageously, the lock is arranged in the same plane as the bevelled portions of the second obturator.

According to an embodiment, the lock comprises two pivoting blades suitable to be coupled to a respective actuator.

According to an advantageous embodiment, the first element, the second element and the lock are each made from a single piece, the device being formed solely from the first and second elements and from the lock.

Another object of the invention relates to a tamperproof container comprising such a dispensing device and a pot containing the objects, said pot being irremovably coupled to the dispensing device.

Said objects can be homeopathic granules, soft capsules, tablets, hard capsules bulk packaged in the pot.

Another object of the invention relates to a secure dispenser of a dose of a therapeutic treatment having the form of one or more objects, said dispenser comprising a housing and a container such as described hereinabove cooperating with said housing, wherein the housing comprises:

- a control unit comprising a processor and a memory wherein the data relative to the treatment is recorded,
- an actuator controlled by said control unit to move the lock into its locked position or into its retracted position.

According to an embodiment, the actuator is a linear actuator.

Alternatively, the actuator is a rotating actuator.

According to an embodiment, the housing comprises at least one sensor coupled to the control unit and suitable for detecting the passage of an object in the chamber and/or in a portion of the conduit located downstream from the second obturator.

Moreover, the housing can comprise at least one sensor coupled to the control unit and suitable for detecting the open or closed configuration of each obturator.

The housing can further comprise a device for identifying the patient coupled to the control unit, the control unit being configured to activate the actuator only if the patient is identified by the device for identifying.

Said device for identifying can comprise a biometric device or an interface for entering an identification code.

According to an embodiment, the dispenser comprises an accelerometer or a gyroscope coupled to the control unit, wherein the control unit is configured to determine the orientation of the dispenser from measurement data from said accelerometer or gyroscope and to activate the actuator only if the dispensing conduit is oriented substantially vertically and the outlet of the dispensing conduit is directed downwards.

The dispenser can also comprise a temperature sensor and a memory configured to save the measurement data from said sensor.

Advantageously, the housing comprises a source of energy that powers the control unit.

According to an advantageous embodiment, the housing comprises a substantially flat base suitable for being placed on a support during the dispensing of the objects.

BRIEF DESCRIPTION OF THE FIGURES

Other characteristics and advantages of the invention shall appear in the following detailed description, in reference to the accompanying drawings wherein.

It goes without saying that these figures show embodiments given for the purposes of illustration, but the invention is in no way limited to the geometry and the arrangement of the components thus represented.

DETAILED DESCRIPTION OF EMBODIMENTS

Objects to be Counted and Dispensed

The invention applies in general to the counting and the dispensing of any object that has a spherical or spheroidal shape or an elongated shape with convex ends. According to a non-limiting embodiment, the objects can have a symmetry of revolution with respect to an axis that extends between the two convex ends.

In the present text, the term "elongated" designates an object of which the largest dimension (or length) extends between the two convex ends.

Elongated objects are intended to be oriented in a conduit of the device for counting and dispensing one after the other in the direction of their largest dimension.

Figure 1:
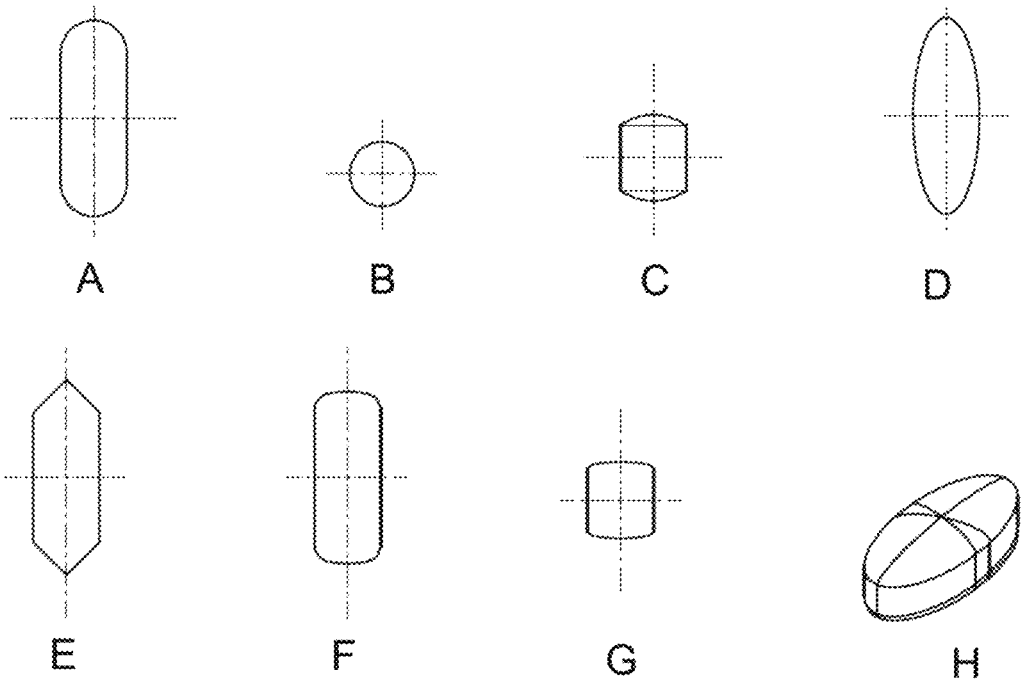
FIG. 1 shows different examples of objects able to be dispensed by the device according to the invention, FIG. 2A diagrammatically shows a first configuration of the obturators of a device according to the invention, FIG. 2B diagrammatically shows a second configuration of the obturators of a device according to the invention, FIG. 2C diagrammatically shows a third configuration of the obturators of a device according to the invention, FIG. 2D diagrammatically shows a fourth configuration of the obturators of a device according to the invention.

FIG. 1 shows some examples of such objects, designated from A to H.

A soft capsule is shown in FIG. 1A. Said soft capsule can be defined as having a cylindrical section with circular section and two symmetrical hemispherical ends, of which the radius of curvature is equal to the radius of the cylindrical portion. The distance between the two hemispherical ends is greater than the diameter of the circular portion.

FIG. 1B shows a spherical object, such as a granule.

FIG. 1C shows a micro-granule, which is a micro-tablet, of a diameter that typically varies from 0.8 to 4 mm, having a constant cylindrical section over a length typically equal to the diameter and having ends of which the section narrows, typically in the shape of a spherical cap.

A hard capsule is shown in FIG. 1D. Said hard capsule can be defined as an ellipsoid of revolution.

FIG. 1E shows an object that has a cylindrical portion of circular section and two symmetrical pointed ends. The distance between the pointed ends is greater than the diameter of the cylindrical portion.

FIG. 1F shows an object that has a cylindrical portion of circular section and two symmetrical rounded ends. The radius of curvature can be more or less large but the case where the ends are flat is excluded.

FIG. 1G shows a limit case where the variation in the sections of the ends decreases very rapidly, without however being a cylinder with a constant section, and for which devices according to the invention are effective.

FIG. 1H shows the case of a tablet that, contrary to the objects of FIGS. 1A to 1G, does not have a symmetry of revolution. This object can be defined as having a straight cylindrical portion of which the base is an ellipse and two faces of ellipsoidal shape. The ends of the object correspond to the ends of the large axis of the ellipse.

Generally, all of the shapes obtained in the area of a solid dose (except for powders, of which the particles are not considered as objects to be counted), can be applied to the objects to be dispensed by the device of the invention.

In pharmaceutical applications, the objects can be granules, micro-granules, hard capsules, tablets, suppositories or soft capsules.

However, any object that has one of the variants of the shapes described hereinabove, regardless of its dimensions and proportions, can be dispensed in a determined number by means of a device according to the invention. The invention can therefore be applied generally in any field of industry, including agri-food, wherein it is necessary to dispense a determined number of objects.

Device for Counting and Dispensing

The device for counting and dispensing objects is similar to that already described in document WO 2015/121353, to which reference may be made for the description of different embodiments.

In reference to FIGS. 2A to 2D, the principle of the device for counting and dispensing (called in what follows of the text "dispensing device" for sake of concision) is recalled.

In these figures, the reservoir 3 of objects 2 (shown here in the form of beads) is located in the upper portion of the dispensing device and communicates with a conduit 100 for dispensing objects that extends according to a longitudinal axis X. The direction of flow of the objects from the reservoir 3 to the outlet of the dispensing device is represented by the arrow. For the dispensing of the objects, the axis X is oriented in a vertical or slanted direction, with the reservoir above the dispensing device, in order to allow the objects to flow via gravity into the conduit 100.

The dispensing device comprises two elements which are slidably moveable relative to each other:

- a first element 10 comprising the conduit 100,
- the second element 11 cooperating with the first to form two obturators 1A, 1B which define, in the dispensing conduit 100 a chamber 101 suitable for containing a predetermined number of said objects.

In the present invention, only a sliding of the two elements in the direction of the axis X of the dispensing conduit is considered.

The conduit 100 has, perpendicularly to the axis X, a section suitable for the passage of a single object, in such a way that the objects are superimposed in the conduit 100.

If the objects to be dispensed are elongated objects, the section of the conduit 100 is adapted for the passage of the objects in the direction of their length, i.e. the objects are superimposed in the conduit 100 with their convex ends facing each other. The section of the conduit 100 does not allow for the passage of an object in an orientation other than that of its length, nor the simultaneous passage of two or more objects through a given section of the conduit.

Advantageously, the junction between the reservoir of objects and the dispensing device has the shape of a funnel that makes it possible to prevent a bracing of the objects at the inlet of the conduit 100. Indeed, spherical or elongated objects with convex ends, in light of their symmetries, can tend to become organised in such a way that, being taken by the centre of the bottom of a reservoir, they themselves form a stable structure, pseudo-tubular and therefore hollow at its centre, that cannot cave in, so that the taking can continue, only under the action of a mechanical mixing.

The inside section of the reservoir 3 is generally greater than that of the conduit 100 and the inside wall of the reservoir advantageously comprises a portion 1130 tilted downstream in the direction of a narrowing of the section. The upstream end of the conduit 100 has a wall 1030 that is inclined in the same direction as the portion 1130.

The obturators 1A and 1B are located respectively in the downstream and upstream portions of the conduit 100 with respect to the direction of flow of the objects in order to exit from the dispensing device.

The obturators 1A and 1B delimit between them a portion of the conduit 100 which is a chamber 101 intended to contain a determined number of objects. In the example shown in FIGS. 2A to 2D, the chamber is intended to receive a single object, i.e. the distance between the obturators 1A and 1B according to the X axis is equal to the nominal diameter of the object, but less than 1.5 times the nominal diameter of said object. However, the dispensing device according to the invention can be designed so that the chamber 101 comprises two or more objects; it is sufficient for this to adapt the distance between the obturators 1A and 1B. The chamber 101 thus fulfils the function of counting objects to be dispensed while still offering the possibility of absorbing the dimensional tolerances inherent to the manufacturing methods of said objects.

Figure 2A:
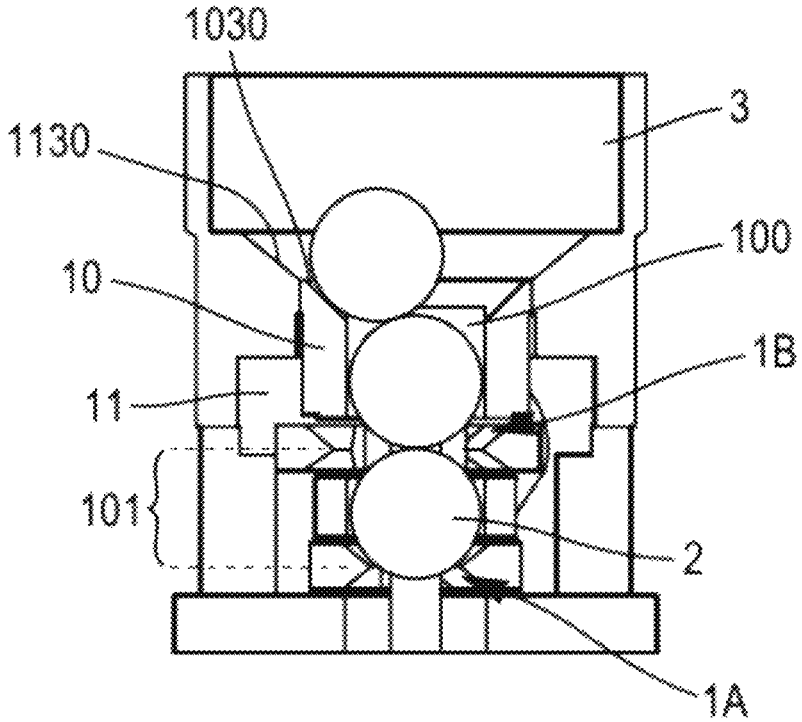
Figure 2B:
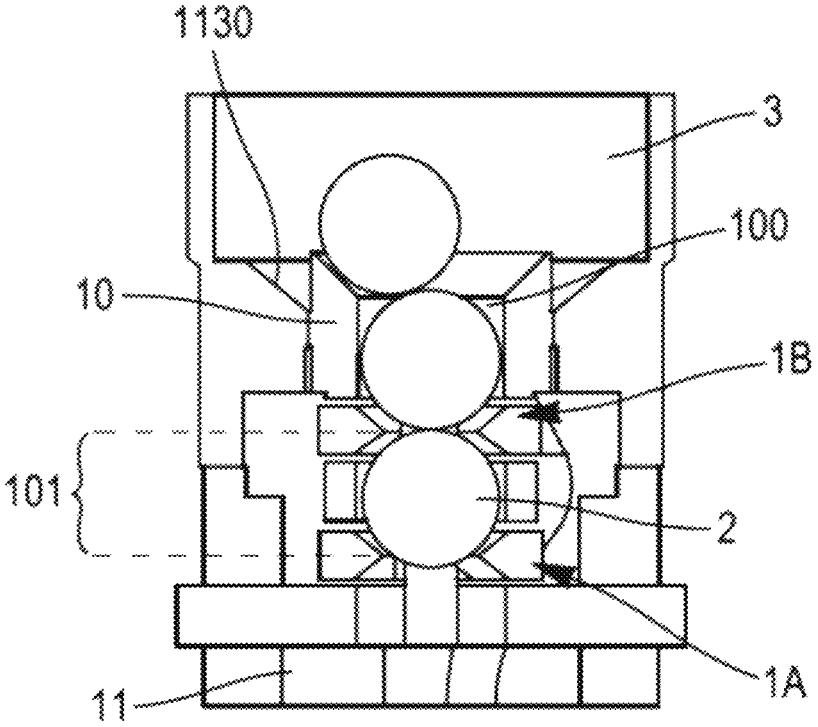
Figure 2C:
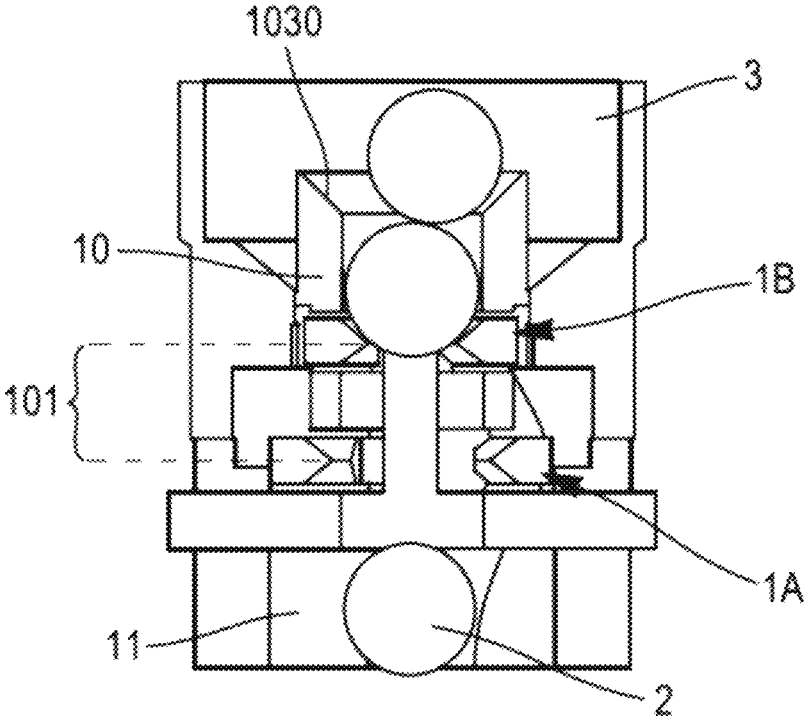

FIG. 2A shows a state of the dispensing device wherein the two obturators 1A, 1B are both in the closed configuration of the chamber 101, which is then empty.

Note that the portions facing the obturators 1A, 1B are not adjoined but separated by an interval less than the diameter of an object, in such a way as to block the passage of an object 2 present in the conduit directly upstream of the obturator 1B. As shall be seen hereinbelow, the fact that the obturators are not adjoined has the advantage of making it possible to retain the objects without exercising any shear on an object contained in the chamber 101. Moreover, the portions facing the obturators advantageously have a bevelled profile.

The fact that the obturator 1B is bevelled makes it possible that during the closing movement of said obturator, exerting shear stress on the object contained in the chamber 101 or on the object located directly upstream of said obturator 1B is prevented.

Finally, FIG. 2D shows a state of the dispensing device wherein the upstream obturator 1B remains in the closed configuration of the chamber 101 while the downstream obturator 1A is in open configuration of said chamber. The passage from the state of FIG. 2C to that of FIG. 2D is obtained by a relative sliding of the two elements of the dispensing device. This sliding is carried out in the direction of the axis X, from downstream to upstream. Note that this sliding has for effect to cause the element 10 to penetrate into the reservoir 3, thus producing a mixing of the objects which very effectively prevents a bracing of the objects at the inlet of the reservoir.

The opening of the downstream obturator 1A allows the object 2 (or objects if two or more objects were contained in the chamber 101) to escape from the chamber and thus be extracted from the dispensing device.

As mentioned hereinabove, the conformation of the obturators, namely that fact that they are not adjoining in the closed configuration and that they have a bevelled profile, makes it possible, during the closing of the obturator to prevent exerting shear stress on an object inserted into the chamber 101 or on an object upstream of the obturator 1B that would be partially engaged in the chamber 101 and this, even if the dimension of the objects varies within a determined range. Moreover, this conformation of the obturator makes it possible to push upstream, without exerting any shear stress able to damage it, a supernumerary object partially engaged in the chamber 101.

Figure 3A:
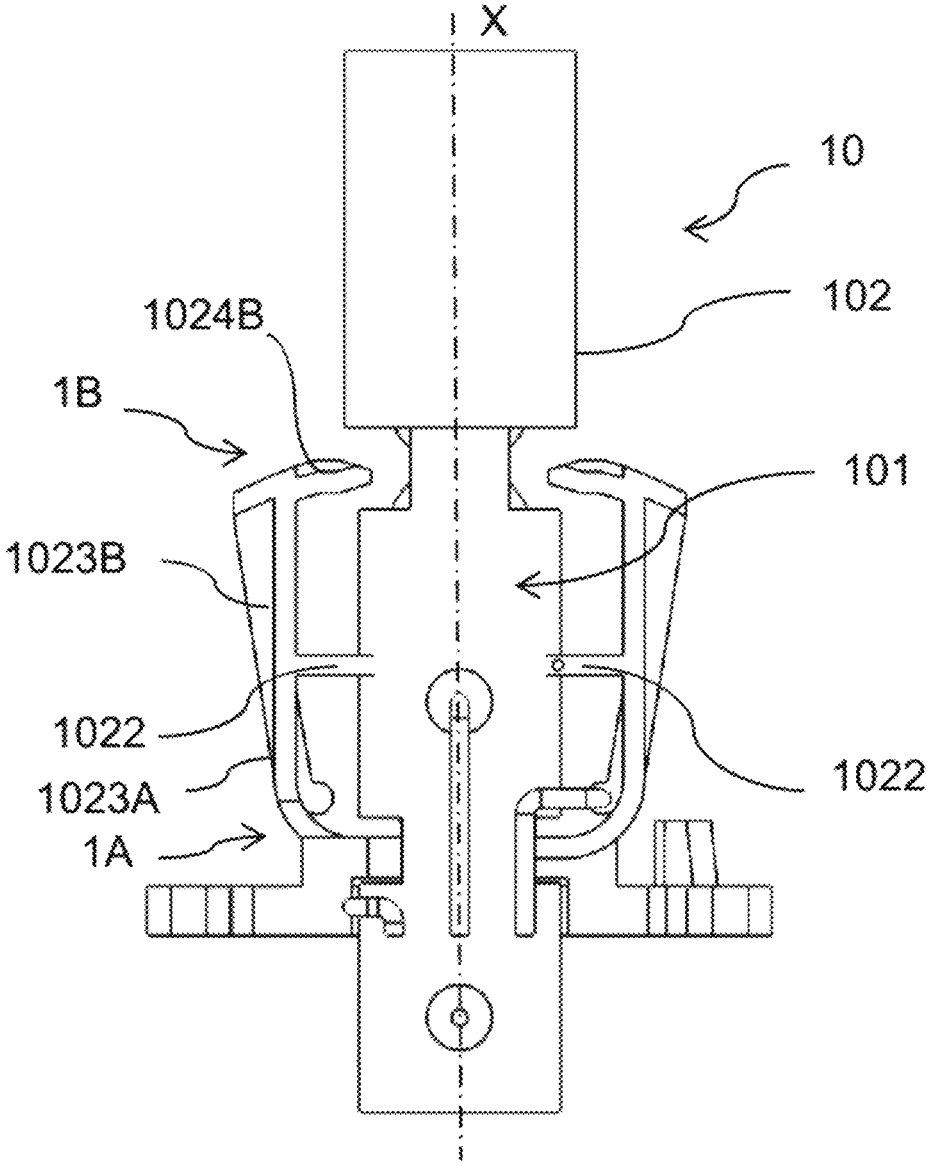
FIG. 3A shows a side view of the fixed element of the dispensing device according to an embodiment.
Figure 3B:
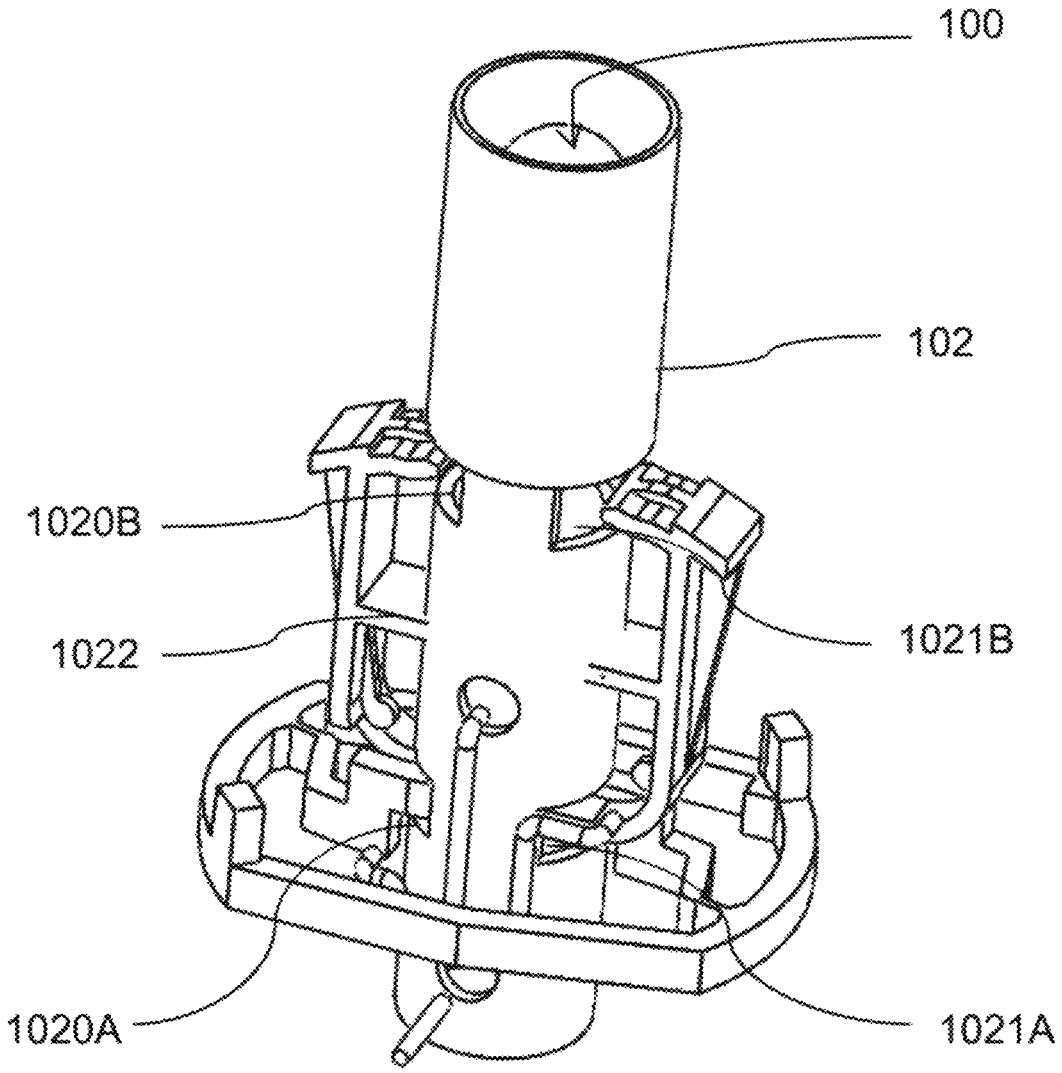
FIG. 3B shows a perspective view of the fixed element of the dispensing device according to an embodiment.

FIGS. 3A and 3B are respectively a side view and a perspective view of an embodiment of the element 10 comprising the dispensing conduit. The element is shown oriented vertically, in a position that makes it possible to have the objects exit from the bottom. The terms "lower" and "upper" or "top" and "bottom" used hereinafter are to be understood with respect to this position.

The element 10 comprises a central drum 102 inside of which the dispensing conduit 100 is arranged. The central drum has two pairs of diametrically opposite openings 1020B-1021B and 1020A-1021A, delimiting the upstream portion and the downstream portion of the counting chamber 101. The central drum 102 also comprises two diametrically opposite feet 1022 extending radially outwards. Each foot supports two arms 1023B, 1023A which extend in a direction substantially parallel to the drum 102, on either side of the foot 1022. Each arm is terminated by an extension extending radially inwards, facing a respective opening 1020B, 1021B, 1020A, 1021A in the drum 102. This extension is designated by the mark 1024B for the arm 1023B, that of the arm 1023A not being visible as it is positioned inside the opening 1020A. Each set formed of a foot 1022 and of its two arms is symmetrical with the other with respect to a plane comprising the axis X.

In light of the shape and of the polymer material used to form the foot and the arms, the arms have a certain elasticity by pivoting around their junction with the foot. The upper arms 1023B are therefore movable between a position where the upper extensions 1024B are close together and penetrate partially into the dispensing conduit 100 through upper openings 1020B, 1021B and a position where the upper extensions 1024B are distant from one another and located outside the dispensing conduit 100, thus releasing the passage of the objects. In other terms, the upper extensions 1024B thus form an upstream obturator 1B of the counting chamber 101.

Likewise, the lower arms 1023A are movable between a position where the lower extensions are close together and penetrate partially into the dispensing conduit 100 through lower openings 1020A, 1021A and a position where the lower extensions are distant from one another and located outside the dispensing conduit 100, thus releasing the passage of the objects. In other terms, the lower extensions thus form a downstream obturator 1A of the counting chamber 101.

As explained hereinabove, the extensions are not adjoining even in their position close together, and have a bevelled end that makes it possible to not apply any shear stress on an object during the bringing closer together thereof.

FIGS. 3A and 3B show the first element in an idle configuration, i.e. a configuration wherein no mechanical stress is applied to the arms. In this configuration, the upper arms 1024B are in a position separated from one another, in such a way that the extensions 1024B define an orifice that is sufficiently wide for the passage of an object. The upstream obturator 1B is therefore in an open configuration of the chamber 101. However, the lower arms 1024A are in a position close to one another, in such a way that the extensions 1024A, although they are not adjoining, define an orifice that is sufficiently narrow to prevent the passage of an object. The downstream obturator 1A is therefore in a closed configuration of the chamber 101.

The second element of the device is conformed to, according to its position in relation to the first element, bring closer or separate the upper and lower arms so as to procure the operating sequence described hereinabove.

Figure 3C:
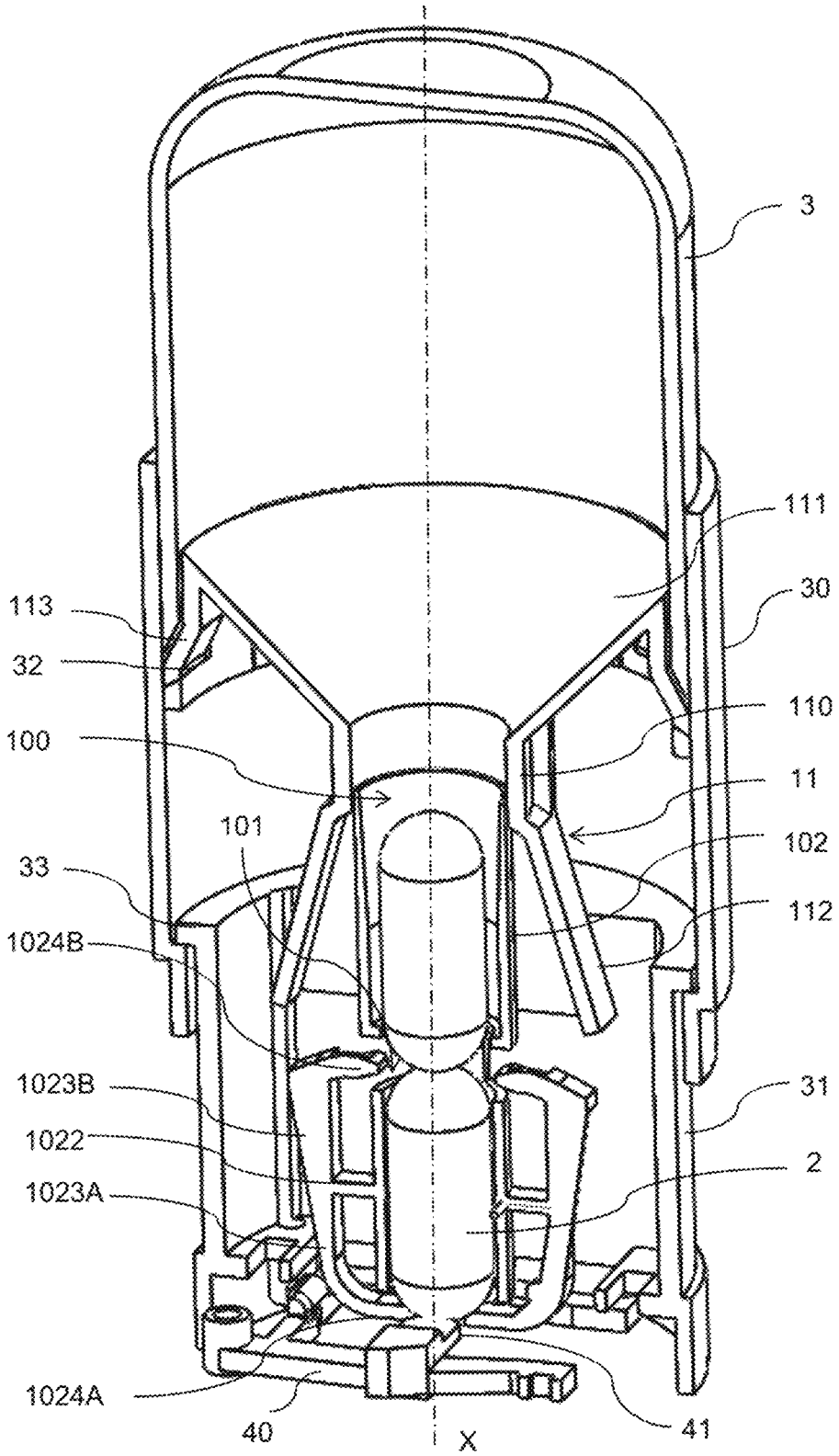
FIG. 3C shows a cross-section view of the dispensing device including the fixed element of FIGS. 3A and 3B and the movable element, in an orientation that allows for the dispensing of an object.

This second element 11 is shown in FIG. 3C assembled with the fixed element 10 of FIGS. 3A and 3B and with a container 3 containing the objects to be dispensed.

The fixed element is rigidly attached to a body 31 which encloses the components of the element 10 in such a way as to render them inaccessible for a user.

The container 3 is slidably mounted in the direction X with respect to the body 31 via a tubular connector 30. The body 31 has an upper collar 33 that forms an axial abutment downwards for the container 3.

The element 11 comprises a cylindrical portion 110 slidably arranged on the drum 102.

On the upstream side, i.e. oriented towards the inside of the container 3, the cylindrical portion 110 is advantageously extended by a funnel 111 that opens into the dispensing conduit 100. Such a funnel, although optional, makes it possible to prevent the bracing of the objects at the inlet of the dispensing conduit 100.

On the downstream side, i.e. oriented towards the downstream obturator 1A, the cylindrical portion 110 is extended by a skirt 112 that flares in the downstream direction.

Advantageously, the cylindrical portion 110, the funnel 111 and the skirt 112 form a single part, that can be carried out by moulding a plastic material.

The element 11 is rigidly attached to the container 3. For example, in the embodiment shown, the portion forming the funnel 111 comprises one or more ergots 113 snap-fitted into the openings 32 formed on the circumference of the container 3. Thus, the element 11 is slidably driven with the container 3 when a thrust effort is exerted on the latter by the user.

The inner surface of the skirt is configured to cooperate with the arms so as to actuate the obturators 1A, 1B. Thus, according to the position of the skirt with respect to the arms, the skirt is able to exert a mechanical stress on the arms 1023B and 1023A in such a way as to elastically deform said arms in order to bring them together or to separate them.

More precisely, the device if configured to procure the following operating sequence.

In an idle configuration, wherein no action is performed by a user to release an object or objects, the first and second elements 10, 11 are in the relative position shown in FIG. 1C. In this position, the skirt 112 is separated from the upper arms 1023A upwards and therefore does not exert any mechanical stress on said arms. As indicated plus haut, the obturator 1B is therefore in an open configuration of the chamber 101, while the obturator 1A is in the closed configuration of the chamber. An object (in the form of a soft capsule in the application shown) is therefore contained in the chamber 101 between the two obturators.

To release said abject, the user has to exert a pressure on the container 3 along the axis X in the downstream direction. Doing this, the second element 11 is slidably driven downwards along the drum 102. The inner surface of the skirt 112 therefore comes into contact with the upper arms 1023B and slides along these arms. Due to the flared form of the skirt, the upper arms 1023B are progressively brought closer to one another, until reaching the closed configuration of the upstream obturator 1B. This first phase of the movement of the second element 11 does not have any effect on the configuration of the downstream obturator 1A, which remains in the closed configuration.

Starting from a certain position of the second element with respect to the first element, a second phase of the movement of the second element 11 is engaged, wherein the skirt 112 exerts a stress on the arms 1023B, 1023A which generates an elastic pivoting of the arms 1023A tending to separate them from one another, until reaching the open configuration of the downstream obturator 1A. During this second phase, the upstream obturator 1B remains in its closed configuration. At the end of this second phase, the object contained in the chamber is released outside the device and thus made available to the user.

When the user releases the pressure on the container, a return means (not shown) brings the container 3 back upwards and therefore the second element 11 to the idle position shown in FIG. 3C. The movement of the second element upwards also comprises two phases: a first phase during which the downstream obturator 1A returns to the closed position (the upstream obturator 1B remaining in the closed configuration) then a second phase during which the obturator 1B returns to the open position (the downstream obturator 1A remaining in the closed configuration). A new object can therefore be introduced into the chamber 101 for the purposes of a new dispensing operation that can be carried out immediately (for example if the dose to be delivered to the user comprises several objects that cannot be released simultaneously) or later.

In any case, the configuration of the first and second elements is such that a situation wherein both the upstream obturator and the downstream obturator would be in an open configuration of the chamber cannot occur.

To secure the device, the latter comprises a lock that can be moved between a lock state wherein said lock cooperates with the downstream obturator to partially close the dispensing conduit, and an unlock state wherein the lock is retracted outside the dispensing conduit.

The lock is arranged inside the dispensing device, in a way that is not accessible to a user. Thus, the lock cannot be actuated by a user from the outside of the dispensing device. As shall be seen hereinbelow, the lock is suitable for cooperating with an actuator arranged in a "smart" housing that controls the actuator only in situations where the user is authorised to take objects.

According to an embodiment, the lock 4 comprises two opposite blades 40 each comprising a transversal finger 41, said finger extending for example perpendicularly to the blade. Said blades 40 can be moved between a locked position wherein their fingers 41 are engaged in the dispensing conduit in such a way as to partially obturator it, and a retracted position wherein said fingers 41 are located outside the dispensing conduit, releasing the passage of the objects. Preferably, in the locked position, the fingers 41 are non-adjoining. In this locked position, the passage of the objects is impossible even if the obturators are open.

Said lock is configured so that the position of an object present in the chamber 101 is not affected by a change in the state of the lock. In practice, the fingers of the blades are arranged in the same plane as the downstream obturator 1A, or in a parallel plane that is close enough to the downstream obturator 1A so that an object cannot be imprisoned between the lock and the obturator, nor damaged by the closing of the obturator. For example, depending on the shape of the objects, a distance of less than 3 mm between the lock and the obturator is preferred.

Moreover, the lock 4 does not interfere with the downstream obturator 1A, in such a way that the lock 4 and the downstream obturator 1A can be actuated independently of one another.

Each blade 40 is rotatably movable about an axis parallel to the axis X. Each blade can be actuated by a respective actuator arranged in the aforementioned housing.

Figure 4A:
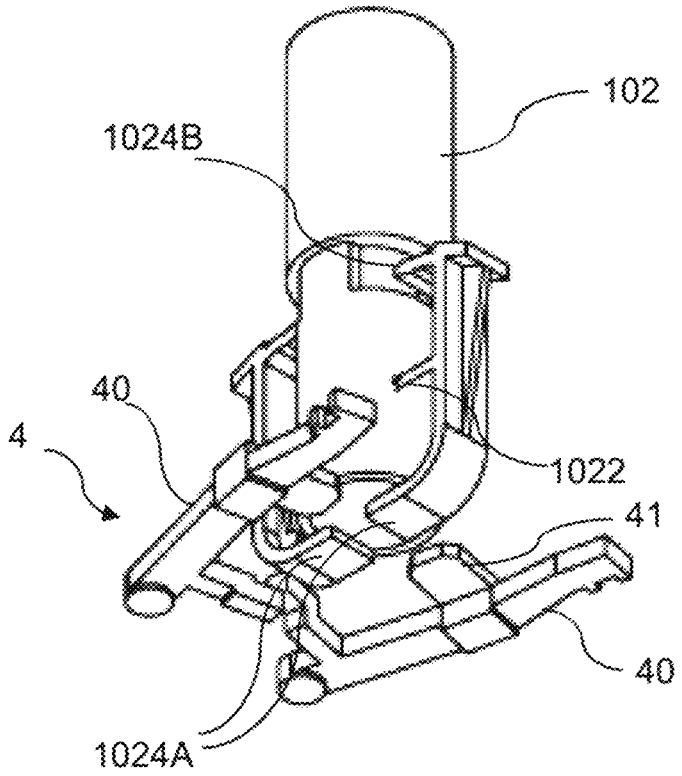
FIG. 4A is a perspective view of a first embodiment of the lock, in the retracted state.
Figure 4B:
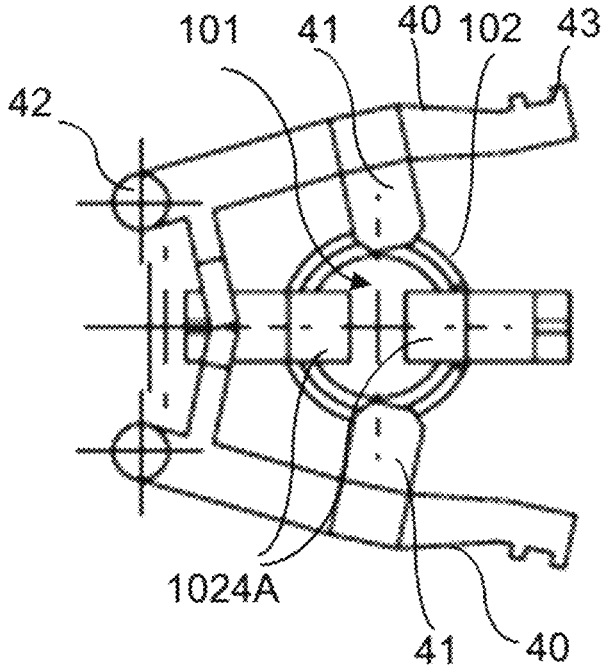
FIG. 4B is a view from underneath of the lock in the retracted state of FIG. 4A.
Figure 4C:
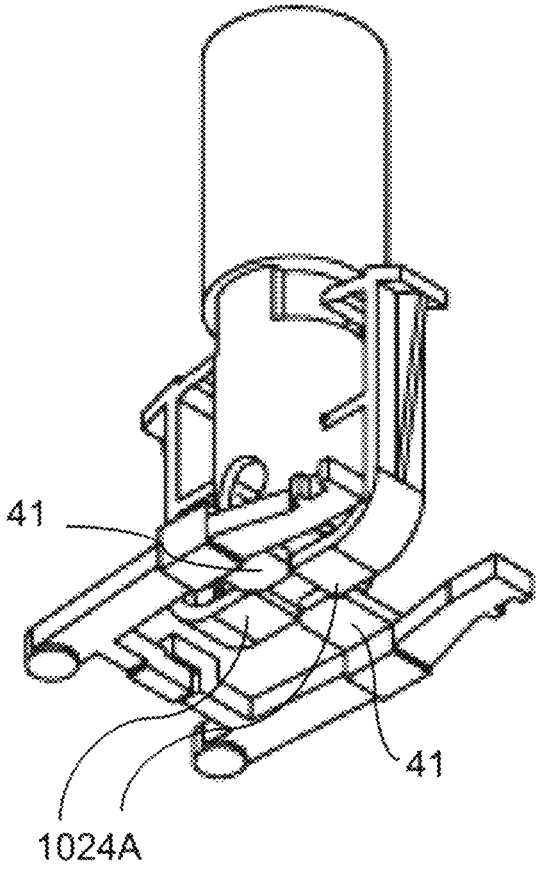
FIG. 4C is a perspective view of said lock in the retracted state.
Figure 4D:
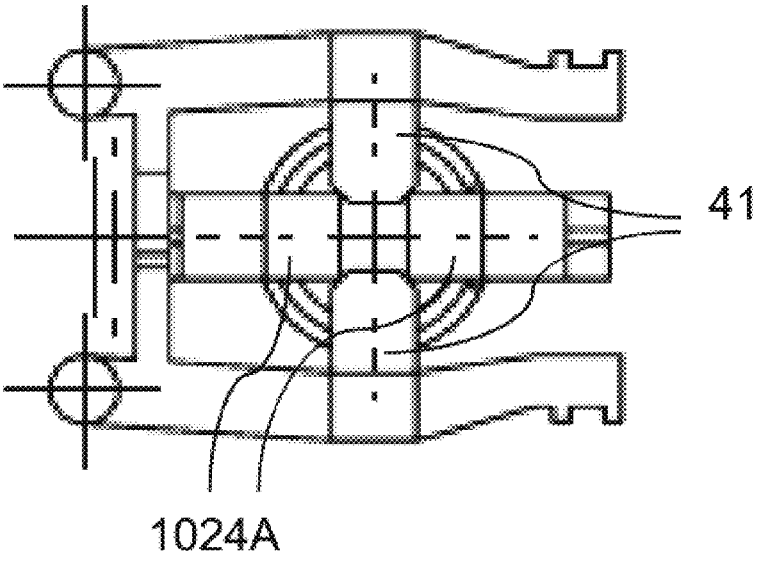
FIG. 4D is a view from underneath of the lock in the retracted state of FIG. 4C.

FIGS. 4A to 4D show a first embodiment of the lock, in the retracted state (FIGS. 4A-4B) and in the lock state (FIGS. 4C-4D).

Each blade 40 comprises a main straight member, extending in a plane perpendicular to the axis X and having at one of its ends a pivot axis 42 parallel to the axis X and at the opposite end 43 a means of connection to an actuator (not shown). The blade also comprises a finger 41 that extends from the main member, substantially perpendicularly to the latter, in a plane perpendicular to the axis X. The blades are arranged in such a way that, in the locked position, the fingers 41 are diametrically opposite with respect to the conduit 100 and perpendicular to the extensions 1024A of the downstream obturator 1A.

Figure 5A:
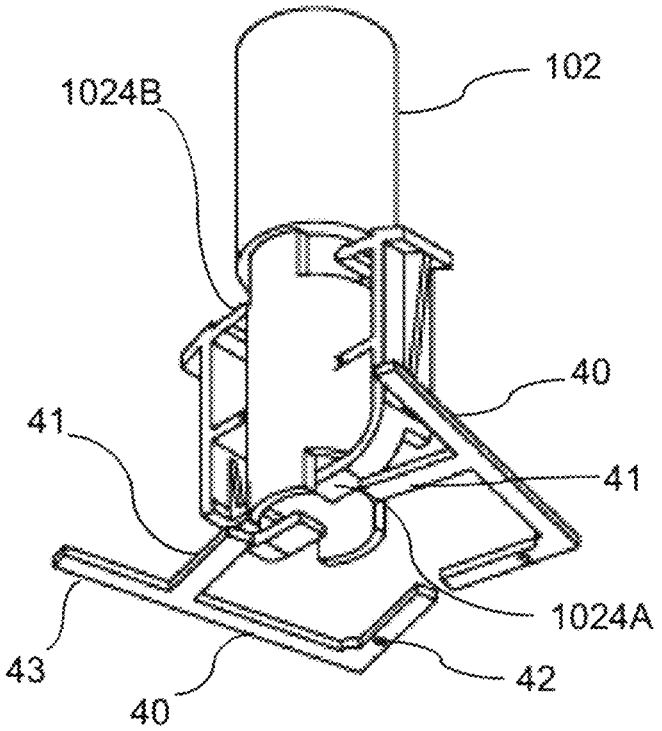
FIG. 5A is a perspective view of a second embodiment of the lock, in the retracted state.
Figure 5B:
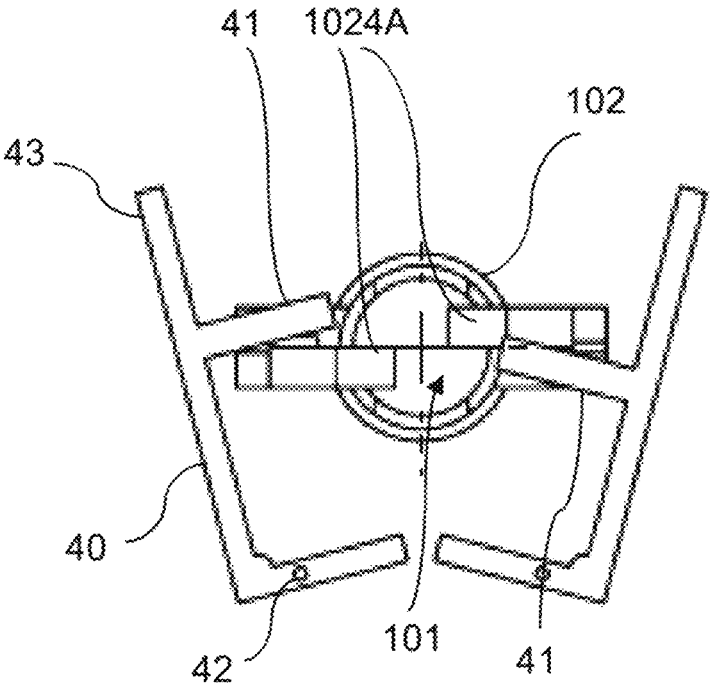
FIG. 5B is a view from underneath of the lock in the retracted state of FIG. 5A.
Figure 5C:
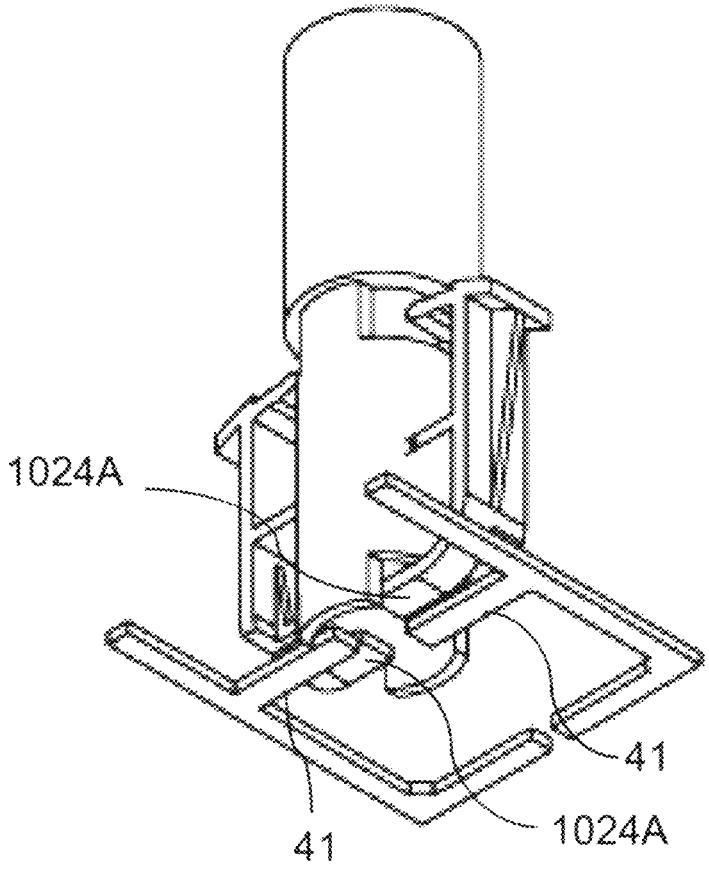
FIG. 5C is a perspective view of said lock in the retracted state.
Figure 5D:
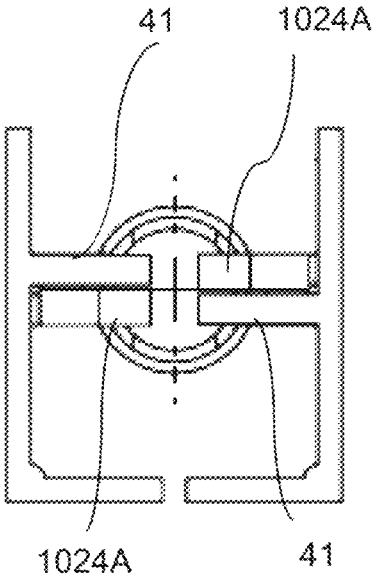
FIG. 5D is a view from underneath of the lock in the retracted state of FIG. 5C.
Figure 6A:
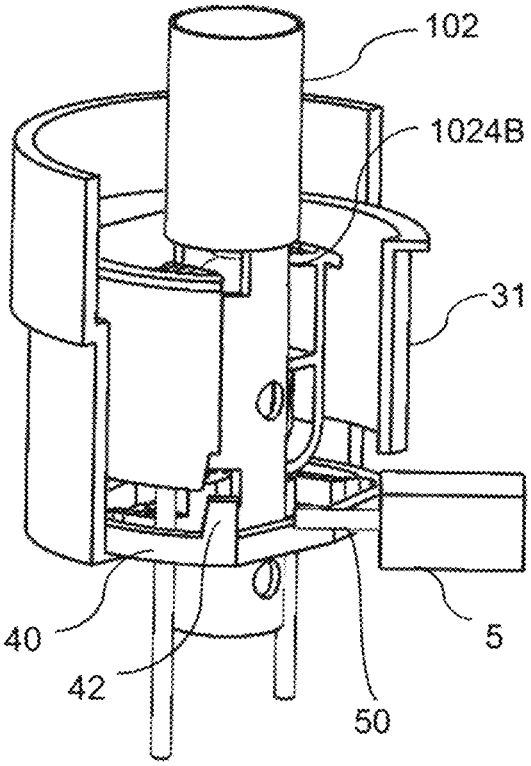
FIG. 6A shows the cooperation of the lock with an actuator, in the retracted state.
Figure 6B:
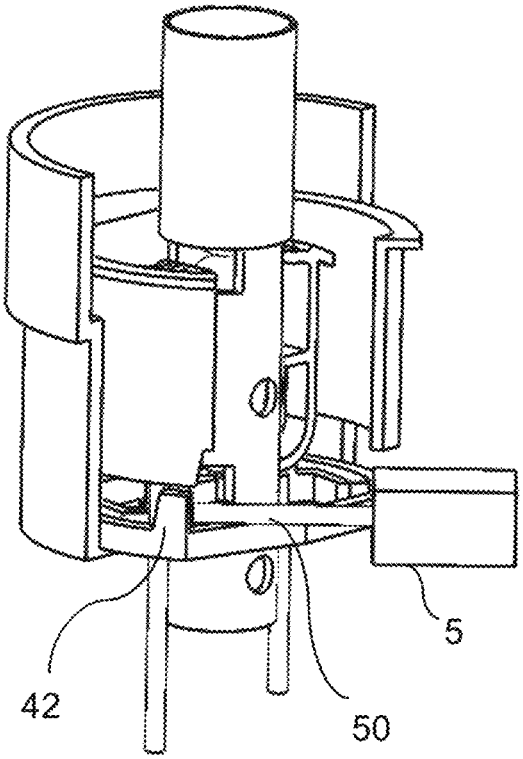
FIG. 6B shows the cooperation of the lock with the actuator, in the lock state.

FIGS. 5A to 5D show a second embodiment of the lock, in the retracted state (FIGS. 5A-5B) and in the lock state (FIGS. 5C-5D).

Each blade 40 comprises a straight main member, extending in a plane perpendicular to the axis X and having at one of its ends a pivot axis 42 parallel to the axis X and at the opposite end 43 a means of connection to an actuator (not shown). The blade also comprises a finger 41 that extends from the main member, substantially perpendicularly to the latter, in a plane perpendicular to the axis X. The blades are arranged in such a way that, in the locked position, the fingers 41 are parallel to the extensions 1024A of the downstream obturator 1A, each finger being facing an opposite extension.

The device for counting and dispensing of which various embodiments have been described hereinabove can have the form of a component to be assembled on a pot containing objects to be dispensed. The dispensing device then has dimensions making it possible to adapt it on an existing container, such as a pot, a tube, etc. The attaching of the dispensing device on the container is carried out by any suitable means, including a weld, gluing, snap-fitting, etc.

Alternately, the counting and dispensing device can comprise the pot, for example by arranging that one of the elements is manufactured in a single piece with the pot.

Housing

The control of the dispensing of the objects is provided by a housing that comprises a control unit and at least one actuator controlled by said control unit, the lock able to be actuated by the actuator only after the device for counting and dispensing has been inserted into the housing and the actuator has received an unlocking instruction from the control unit. Such an instruction intervenes when the control unit has determined that one or more objects are to be dispensed. To carry out this determination, the control unit uses as a basis data relative to the treatment, such as the identity of the patient, the scheduled programme for taking the treatment (date, time, quantity of objects taken at a time, etc.).

The dispensing device and the housing form together a secure dispenser of a dose of a therapeutic treatment.

Figure 8:
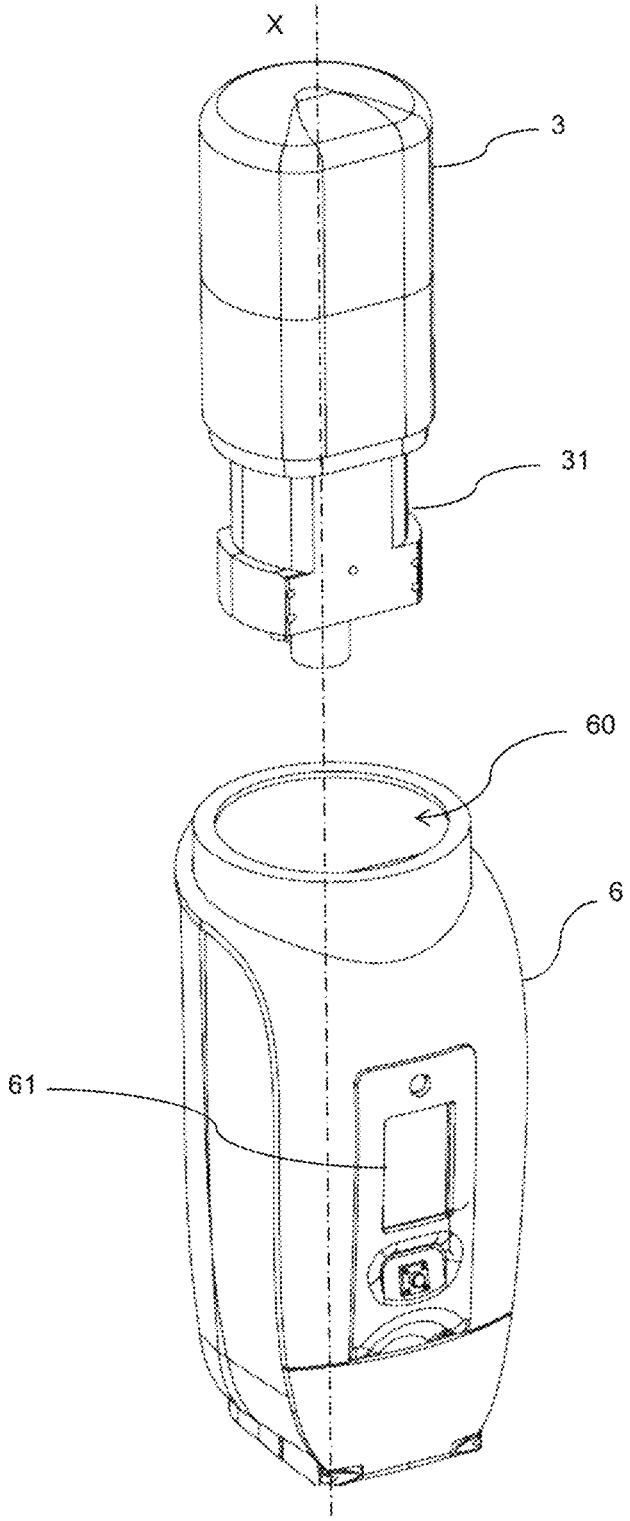
FIG. 8 is a view of the device for counting and dispensing and of the housing before assembly.
Figure 9:
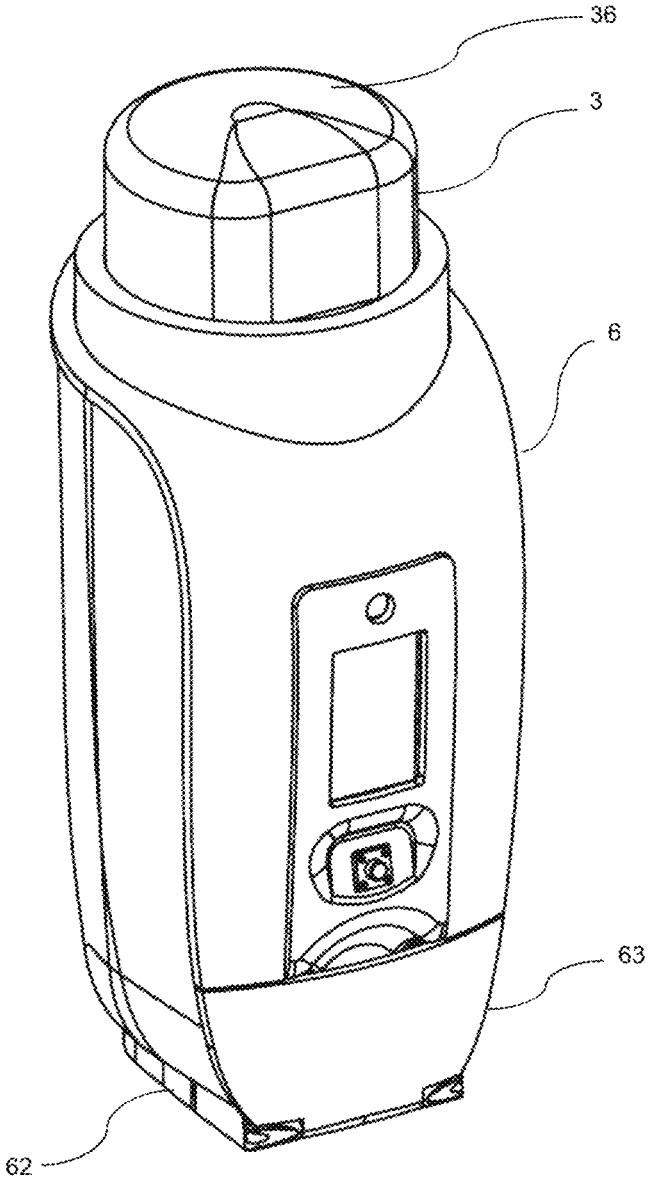
FIG. 9 is a view of the device for counting and dispensing and of the housing after assembly.

FIGS. 8 and 9 are perspective views of the housing 6 and of a container 3 comprising the dispensing device (such as already described in reference to FIG. 3C), respectively before and after assembly.

Preferably, the dispensing device and the housing are sufficiently compact and light so that the dispenser can be carried by hand, i.e. able to be transported with a single hand by the user.

The control unit typically comprises a processor as well as a memory wherein data relative to the treatment is recorded and/or a means for interrogating a remote server that has this data. Advantageously, the control unit comprises both a memory wherein this data is recorded (for example by a practitioner) and a means for interrogating a server whereon said data is also accessible, which makes it possible if necessary to perform a double verification before authorising the dispensing of one or more objects.

According to an embodiment, the actuator is a linear actuator.

According to another embodiment, the actuator is a rotating actuator coupled to a cam.

Particularly advantageously, the housing comprises one or more sensors coupled to the control unit, chosen in particular from the various sensors described hereinafter.

A first sensor is a sensor suitable for detecting the presence or the passage of an object in the chamber and/or in a portion of the conduit located downstream from the second obturator.

A second sensor is a sensor suitable for detecting the open or closed configuration of each obturator.

A third sensor is a sensor suitable for detecting the state of the lock.

Said sensors are advantageously optical forks, comprising an emitter and a receiver arranged facing one another, at a certain distance wherein is arranged the element for which it is desired to determine the position or the state. Advantageously, the housing comprises light guides arranged on the one hand between the transmitter and a side of the element, and on the other hand between the receiver and the side opposite the element. These light guides make it possible to position the emitter/receiver at a single location of the housing for all the sensors, which increases the compactness of the system. Naturally, those skilled in the art can choose another known sensor technology suitable for this use.

Figure 7:
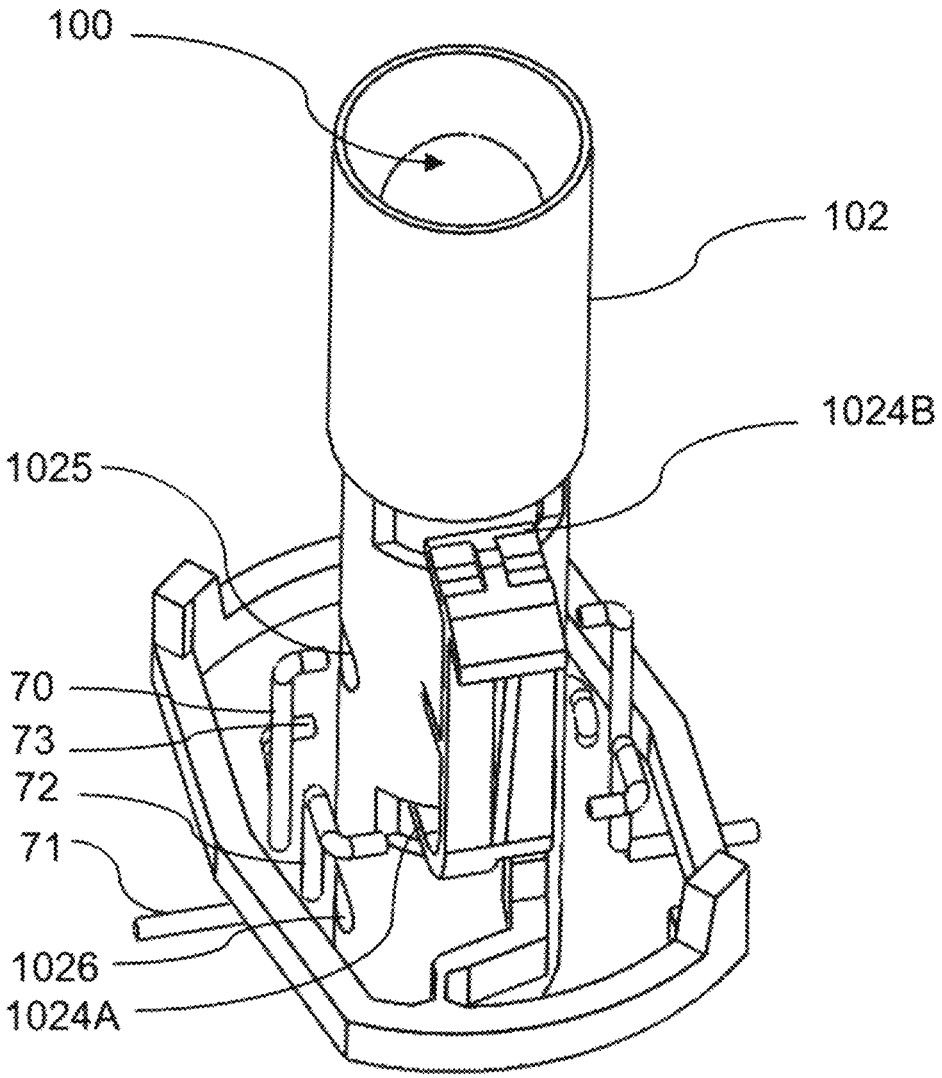
FIG. 7 shows light guides arranged in the dispensing device to cooperate with the optical sensors.

FIG. 7 shows an embodiment including such light guides. The drum 102 can comprise two orifices: an orifice 1025 that opens into the chamber 101, and an orifice 1026 that opens into a portion of the dispensing conduit 100 downstream from the obturator 1A. A light guide 70 is arranged between an optical sensor (not shown) and the orifice 1025, so as to make it possible to detect the presence of an object in the chamber 101. A light guide 71 is arranged between an optical sensor (not shown) and the orifice 1026, so as to be able to detect the passage of an object through the downstream obturator. A light guide 72 is arranged facing each extension 1024A, so as to be able to determine the configuration (open or closed) of the obturator 1A. Finally, a light guide 73 is arranged facing the finger of each blade, so as to make it possible to determine the state (retracted or locked) of the lock.

Advantageously, the housing further comprises a device for identifying the patient coupled to the control unit, the control unit being configured to activate the actuator only if the patient is identified by the device for identifying. This device for identifying can comprise a biometric device, and/or an interface for entering an identification code. Such devices are known and therefore will not be described in detail in the present text.

Particularly advantageously, the dispenser comprises an accelerometer or a gyroscope coupled to the control unit. The control unit is configured to determine the orientation of the dispenser from measurement data from said accelerometer or gyroscope and to activate the actuator only if the dispensing conduit is oriented substantially vertically downwards in order to allow for the dispensing of an object. In other terms, the two obturators must be aligned vertically and the second obturator has to be located under the first obturator. This makes it possible to prevent the introduction of an object into the dispensing device when the second obturator is open.

According to an embodiment, the dispenser comprises a temperature sensor and a memory (which can be the memory of the aforementioned control unit) configured to save the measurement data from said sensor. This recording of the temperature over time can make it possible to verify that the drug has not been exposed to a temperature that can degrade it. The control unit can be configured to issue an alarm if the temperature exceeds a predefined limit.

The dispenser can further comprise a clock, with the information concerning the date and the time being transmitted to the processor for the monitoring of the scheduled programme for taking the treatment.

According to an embodiment, the housing comprises a source of energy (button cell or battery, advantageously rechargeable) that powers the control unit. Thus, the dispenser is autonomous and can be moved easily by the user.

According to a particularly preferred embodiment, the housing comprises a substantially flat base 62 suitable for being placed in a stable manner on a support during the dispensing of the objects. Thus, once the dispensing device has been set in place in the housing, the user simply has to exert a vertical pressure downwards using a single hand (the other hand remaining free or being used only to maintain the housing) on the movable element of the dispensing device (here, the top 36 of the container 3) to have it slide with respect to the fixed element and to release the required number of objects. In light of the orientation of the dispensing device, the objects fall via gravity into a lower portion of the housing 6, accessible via a trapdoor 63.

Although the various sensors, the accelerometer or the gyroscope described hereinabove can be integrated into the dispensing device, they will more preferably be integrated into the housing.

Thus, the dispensing device can advantageously be discarded, i.e. once emptied of all the objects, it cannot be disassembled then filled with new objects. As the dispenser is formed of parts moulded in plastic material, it is particularly inexpensive and easy to recycle.

On the other hand, the housing 6, which comprises the processor and the other electronic components of the control unit, the actuator, the various sensors, the device for identifying, the accelerometer and/or the gyroscope, which can be relatively expensive and potentially complex to recycle, can be reused.

Operation of the Dispenser

The dispenser operates in the following way.

The user takes a container 3 comprising the dispensing device and the objects forming the treatment, which are packaged in bulk in the container. The downstream obturator is in the closed configuration and the lock is in the locked position, in such a way that they obturator together at least partially the dispensing conduit.

The user inserts the container 3 into the housing 6.

At the end of this operation, each blade of the lock is facing the respective actuator present in the housing.

According to the data on the treatment that was recorded beforehand in the memory of the control unit, the control unit can trigger or not a command to open the lock in the retracted position thereof. Such a command can for example by triggered if the user is duly identified by means of a device for identifying such as mentioned hereinabove, and if the time indicated by the clock is in a scheduled range of time in the plan for taking the treatment. Otherwise, for example if the user has not been recognised by the device for identifying, or if the time indicated by the clock is outside of the range or ranges scheduled in the plan for tacking the treatment, the control unit does not trigger any command of the actuator.

The user presses the top of the container 3, which is rigidly connected to the second element of the device for counting and dispensing downwards, then releases it, which triggers the operating sequence of the obturators and makes it possible, if the lock is in its retracted position, the exiting of one or more objects.

The sensors advantageously make it possible to count the number of objects exiting the chamber.

Once the number of objects to be delivered has been reached, the control unit sends to the actuator a command to bring the lock into its locked position.

Consequently, even if the user actuates the device again, no additional object will exit therefrom.

The invention claimed is:

1. A device for counting and dispensing objects, comprising first and second elements which are slidably moveable relative to each other along a sliding direction, the a first element comprising a conduit for dispensing the objects to be counted and dispensed, said conduit extending in the sliding direction, the second element cooperating with the first element to form first and second obturators which define, in the dispensing conduit, a chamber configured for containing a predetermined number of said objects, said first and second obturators being able to adopt, according to the relative position of said first and second elements:

a so-called open configuration of the chamber, wherein each obturator defines an orifice of a dimension suitable for the passage of an object to be counted and dispensed, and a so-called closed configuration of the chamber, wherein said orifice has a dimension that is insufficient for the passage of an object, each obturator having two non-adjoining facing bevelled portions in said closed configuration, the first and second elements being arranged to procure, by relative sliding, an operating sequence of the obturators wherein:

(i) the first obturator is in the open configuration while the second obturator is in the closed configuration, (ii) the first and the second obturators are both in the closed configuration, (iii) the first obturator is in the closed configuration while the second obturator is in the open configuration, (iv) the first and the second obturators are both in the closed configuration, the device being configured for being inserted into a housing comprising a control unit and at least one actuator controlled by said control unit, the device further comprising a lock that can be moved by the actuator between a lock state wherein said lock partially obturators the dispensing conduit, and an unlock state wherein the lock is retracted outside the dispensing conduit, said lock being configured so that a position of an object present in the chamber is not affected by a change in the state of the lock.

2. The device of claim 1, wherein the lock is arranged in a same plane as the bevelled portions of the second obturator.

3. The device of claim 1, wherein the lock comprises two pivoting blades suitable to be coupled to a respective actuator.

4. The device of claim 1, wherein the first element, the second element and the lock are each made from a single piece, the device being formed solely from the first and second elements and from the lock.

5. A container comprising the dispensing device as claimed in claim 1 and a pot containing the objects irremovably coupled to said dispensing device.

6. The container of claim 5, wherein the objects are homeopathic granules, soft capsules, tablets, hard capsules bulk packaged in the pot.

7. A secure dispenser of a dose of a therapeutic treatment having the form of one or more objects, said dispenser comprising a housing and a container as claimed in claim 5 cooperating with said housing, wherein the housing comprises:

a control unit comprising a processor and a memory wherein the data relative to the treatment is recorded, an actuator controlled by said control unit to move the lock into its locked position or into its retracted position.

8. The distributor of claim 7, wherein the actuator is a linear actuator.

9. The distributor of claim 7, wherein the actuator is a rotating actuator.

10. The distributor of claim 7, wherein the housing (6) comprises at least one sensor coupled to the control unit and suitable for detecting the passage of an object in the chamber and/or in a portion of the conduit located downstream from the second obturator.

11. The distributor of claim 7, wherein the housing comprises at least one sensor coupled to the control unit and suitable for detecting the open or closed configuration of each obturator.

12. The distributor of claim 7, comprising an accelerometer or a gyroscope coupled to the control unit, wherein the control unit is configured to determine the orientation of the dispenser from measurement data from said accelerometer or gyroscope and to activate the actuator only if the dispensing conduit is oriented substantially vertically and the outlet of the dispensing conduit is directed downwards.

13. The distributor of claim 7, comprising a temperature sensor and a memory configured to save the measurement data from said sensor.

14. The distributor of claim 7, wherein the housing comprises a source of energy that powers the control unit.

15. The distributor of claim 7, wherein the housing comprises a substantially flat base suitable for being placed on a support during the dispensing of the objects.

16. The distributor of claim 7, wherein the housing further comprises a device for identifying the patient coupled to the control unit, the control unit being configured to activate the actuator only if the patient is identified by the device for identifying.

17. The distributor of claim 16, wherein the device for identifying comprises a biometric device.

18. The distributor of claim 16, wherein the device for identifying comprises an interface for entering an identification code.

* * * * *